US005934280A

United States Patent [19]

Viard et al.

[11] Patent Number: 5,934,280

[45] Date of Patent: Aug. 10, 1999

[54] METHOD AND A DEVICE HAVING A TAP-FED HEEL SUPPORT REGION

[75] Inventors: Jean-Louis Viard, Grabels; Gilles Camus, Montpellier, both of France

[73] Assignee: Support Systems International Industries, Montpellier, France

[21] Appl. No.: 08/896,612

[22] Filed: Jul. 18, 1997

[30] Foreign Application Priority Data

Jul. 23, 1996 [FR] France ..... 96.09204

[51] Int. Cl.[6] ..... A61G 00/00

[52] U.S. Cl. ..... 128/845; 128/882; 5/710

[58] Field of Search ..... 128/845, 846, 128/882, DIG. 20; 5/710, 713, 689

[56] References Cited

U.S. PATENT DOCUMENTS

| | | | |
|---|---|---|---|
| 5,086,529 | 2/1992 | DeGroot | 5/710 |
| 5,168,589 | 12/1992 | Stroh | 5/710 |
| 5,249,318 | 10/1993 | Loadman | 5/423 |
| 5,272,778 | 12/1993 | Gore | 5/453 |

FOREIGN PATENT DOCUMENTS

| | | |
|---|---|---|
| 0 676 158 A1 | 10/1995 | European Pat. Off. . |
| 1 601 808 | 11/1981 | United Kingdom . |

*Primary Examiner*—Michael A. Brown
*Attorney, Agent, or Firm*—Wolf, Greenfield & Sacks, P.C.

[57] ABSTRACT

The invention concerns a method of supporting the body of a patient, the method consisting in providing at least one support element, such as a mattress, subdivided into at least two closed, flexible, controlled-release regions that are inflatable with fluid under a pressure that is a function of the set penetration distance to which the body of the patient penetrates into the support element, namely at least one first support region for supporting the body of the patient other than in its heel region, and a second support region specifically for supporting the heel region. According to the invention, the second support region is inflated by tapping fluid from the first support region. This method makes it easy, in particular, to adjust the pressure as a function of the relative position of the patient on the support, of the patient's weight, of the patient's morphology, or else as a function of the particular needs of the treatment.

40 Claims, 4 Drawing Sheets

PROR ART

INVENTION

METHOD AND A DEVICE HAVING A TAP-FED HEEL SUPPORT REGION

The invention essentially relates to a method and a device having a heel support region that is tap-fed.

BACKGROUND OF THE INVENTION

The assignee's prior document FR-A-2 718 347=EP-A-0 676 158 discloses a method and apparatus for supporting an element to be supported, in particular the body of a patient, making it possible to support the element at an essentially constant controlled penetration depth by means of a measurement device comprising an induction system combined with a piece of metal foil situated under the body being supported, the metal foil being displaced by penetration of the body being supported. The support device may comprise a single chamber, as shown in FIG. 1 of that document, and reproduced in accompanying FIG. 1. Alternatively, as shown in FIG. 3 of the assignee's prior document, provision is made for a support device that has three chambers 114*a,* 114*b,* 114*c* including a chamber for the heel region, each chamber being provided with a respective measurement device for measuring penetration depth, so as to enable each chamber to be individually controlled to remain at a suitable respective inflation pressure. That procedure complicates the apparatus and its method of operation.

OBJECTS AND BRIEF SUMMARY OF THE INVENTION

Therefore, a main object of the present invention is to solve the new technical problem consisting in providing a solution which makes it possible to support the body of a patient by using at least two support regions, including a region specifically for the heel, while keeping the structure and operation of the apparatus simple.

Another main object of the present invention is to solve the above-mentioned new technical problem by providing a solution which makes it possible for the pressure in the heel region to continue to be adjusted independently of the pressure in the region for supporting parts of the body other than the heels, while retaining the simple structure and simplified operation of the apparatus.

Both these technical problems are solved for the first time by the present invention in a way that is simple, that is cheap, and that can be used on an industrial and medical scale.

In a first aspect, the present invention provides a method of supporting the body of a patient, the method consisting in providing at least one support element, in particular a mattress, subdivided into at least two closed, flexible, controlled-release regions that are inflatable with fluid under a pressure that is a function of the set penetration distance to which the body of the patient penetrates into the support element, namely at least one first support region for supporting the body of the patient other than in its heel region, and a second support region specifically for supporting the heel region, wherein the second support region is inflated by tapping fluid from the first support region.

In an advantageous embodiment of the invention, the pressure in the second support region is adjustable as a function of the pressure in the first support region.

In another advantageous embodiment of the invention, the pressure in the second support region for supporting the heel region is substantially constant. In which case, the pressure ratio between the two regions is advantageously variable.

In another advantageous embodiment of the invention, the pressure in the second support region for supporting the heel region is a constant fraction of the pressure in the first support region.

In a second aspect, the present invention also provides a device for supporting the body of a patient, the device including at least one support element, in particular a mattress, subdivided into at least two closed, flexible, controlled-release regions that are inflatable with a fluid under a pressure that is a function of the set penetration distance to which the body of the patient penetrates into the support element, namely at least one first support region for supporting the body of the patient other than in its heel region, and a second support region specifically for supporting the heel region, wherein the second support region is connected to the first support region so as to be inflated by tapping fluid from the first support region.

In a particularly advantageous embodiment of the device of the invention, the link between the first support region and the second support region for supporting the heel region includes a pressure-regulating valve.

In another variant embodiment, the pressure-regulating valve is adjusted to give a pressure value that is substantially constant in the second support region.

In another variant embodiment, the pressure-regulating valve is adjusted to give a pressure value in the second support region for the heel that constitutes an essentially constant fraction of the pressure in the first support region.

In a particularly advantageous embodiment of the invention, the regulating valve comprises an admission chamber having an inlet communicating with said first support region and an outlet communicating at least temporarily with a pressure-regulating chamber whose outlet communicates with the second support region for supporting the heel region, and an independent damping chamber separated from the pressure-regulating chamber by a moving partition supporting a piston for closing off an orifice via which the admission chamber communicates with the pressure-regulating chamber.

In an advantageous variant embodiment, the admission chamber and the pressure-regulating chamber also communicate with each other continuously via a calibrated orifice.

In another advantageous variant embodiment, the damping chamber communicates continuously with the outside via a calibrated orifice.

In another particularly advantageous embodiment of the invention, the second support region for supporting the heel region communicates continuously with the outside via a calibrated orifice.

In the context of the invention, a controlled penetration depth measurement device may be provided, as described in Document FR-A-2 718 347=EP-A-0 676 158.

By means of the invention, since the heel support region taps inflation fluid from the first support region for mainly or essentially supporting the patient other than in the heel region, the pressure in the heel support region is lower than that in the remainder of the support so that the heels penetrate into the mattress, and the legs rest over their entire lengths on the support, thereby relieving the pressure exerted on the heels.

By means of the invention, the pressure can be adjusted easily as a function of the relative position of the patient on the support, of the patient's weight, and of the patient's morphology, or else as a function of the particular needs of the treatment.

In the context of the invention, it can be understood that a low-pressure region is created in particularly simple manner in the heel region whose pressure is a function of the pressure existing in the main region(s).

In the context of the invention, and by means of the presence of the pressure-regulating valve, it is possible to adjust the value of the pressure existing in the heel region either to a constant pressure which is always a fraction of the pressure in the main region(s), or in a constant ratio relative to the pressure in the main region(s), the valve then having a pressure-dividing function.

Naturally, the pressure-regulating valve may be implemented in any practical form, i.e. in a mechanical form, or an electronic form, or in the form of any other suitable pressure-regulating device.

By means of the invention, the pressure exerted on the heels is relieved, thereby preventing bedsores from developing, the heel being one of the regions of the body that are most sensitive to bedsores developing on a patient confined to bed for a prolonged period.

The invention can therefore be used particularly advantageously in preventing or medically treating bedsores.

BRIEF DESCRIPTION OF THE DRAWINGS

Other objects, characteristics and advantages of the invention will appear clearly on reading the following explanatory description made with reference to a currently preferred embodiment of the invention given by way of illustration and therefore in no way limiting the scope of the invention. In the drawings.

MORE DETAILED DESCRIPTION

Figure 1:
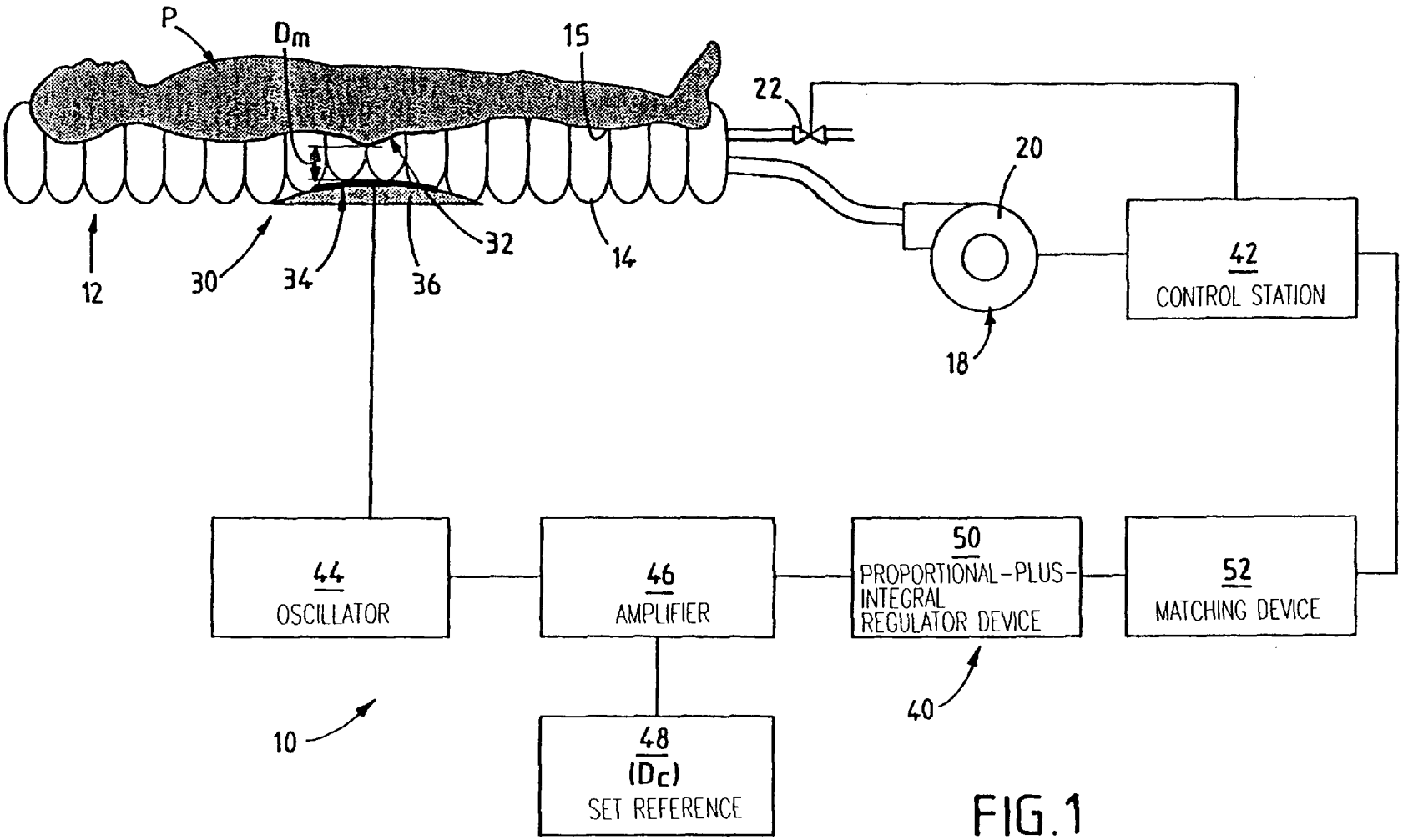
FIG. 1 is a diagrammatic view of an embodiment of support apparatus as described with reference to FIG. 2 of the assignee's prior document: FR-A-2 718 347=EP-A-0 676 158.

FIG. 1 shows prior art support apparatus as described with reference to FIG. 2 of Document FR-A-2 718 347=EP-A-0 676 158, and given the overall reference 10. This support apparatus makes it possible to support an element, in particular the body of a patient P, as shown.

The apparatus 10 includes a support device proper 12, e.g. a mattress, comprising at least one closed or controlled-release chamber 14 that is flexible and inflatable. For example, the chamber may be composed of a multitude of inflatable tubes that communicate with one another, said chamber 14 being inflatable under an adjustable predetermined initial inflation pressure. The chamber 14 has a top face 15 serving to support the element to be supported P, and a bottom face 16 which may, for example, rest on a base (not shown) or on equivalent means. The apparatus further includes servo-control means 18 for servo-controlling the pressure at which the chamber 14 is filled as a function of the distance to which the element being supported penetrates into the support device. For example, said servo-control means may comprise filling means 20, such as pumping means 20 for pumping a flow of fluid into the chamber 14, e.g. a gas, in particular air, or a liquid, in particular water, and they may include emptying means such as a valve 22.

The apparatus also includes measurement means 30 for measuring the distance D between the top face 15 of the chamber and its bottom face 16.

For example, the measurement means 30 may include a metal element 32, advantageously in the form of a piece of thin foil, secured to the top face 15 of the chamber 14, in this example inside said chamber 14, and cooperating with at least one inductive element 34 forming a position detector secured to the bottom face 16 of said chamber 14, which inductive element may be disposed inside the chamber, integrated into the bottom face of the chamber 14, or else it may be secured to the outside of the bottom face 16 of the chamber 14, as shown.

The apparatus also includes control means 40 that act on the servo-control means 18 for servo-controlling the inflation pressure of the chamber 14 to ensure that, while the element is being supported, the distance D as measured between the top face 15 and the bottom face 16 of the chamber 14 is kept preferably at a predetermined distance value, e.g. an essentially constant value, i.e. a value essentially equal to a reference distance $D_c$, or within an acceptable range of variation thereabout.

The control means 40 may advantageously include a control station 42 comprising an electronic or an electromechanical central processing unit having a memory, which unit continuously or intermittently receives signals that are proportional to the measured distance value $D_m$ as transmitted by the above-mentioned measurement means 30, and compares the measured distance values $D_m$ with the reference distance value $D_c$. The control station 42 controls the servo-control means 20, 22 for servo-controlling the inflation pressure of the chamber 14 so that a measured distance $D_m$ is obtained that is essentially constantly equal to the reference distance $D_c$ or within an acceptable range of variation thereabout.

The control means 40 may include an oscillator device 44 described in the assignee's prior application and coupled to the inductive element 34, such as an induction coil, an amplifier device 46 whose gain may be adjusted by a reference setting device 48 defining the reference distance $D_c$. The amplifier 46 is then coupled to a proportional-plus-integral regulator device 50 coupled to a matching device 52 whose output is coupled to the control station 42.

The control means 40 are described in detail in the assignee's previous document FR-A-2 718 347=EP-A-0 676 158 in its description relating to FIGS. 1 to 4 and FIG. 6 thereof.

In the embodiment shown in the present FIG. 1, the inductive element 34, such as an induction coil, is, for example, disposed on a reinforcing member 36 in the vicinity of that region of the element being supported P which has the largest mass or which is most protuberant, namely the sacral region of the patient P in this example, as explained in the assignee's above-mentioned prior document.

Figure 3:
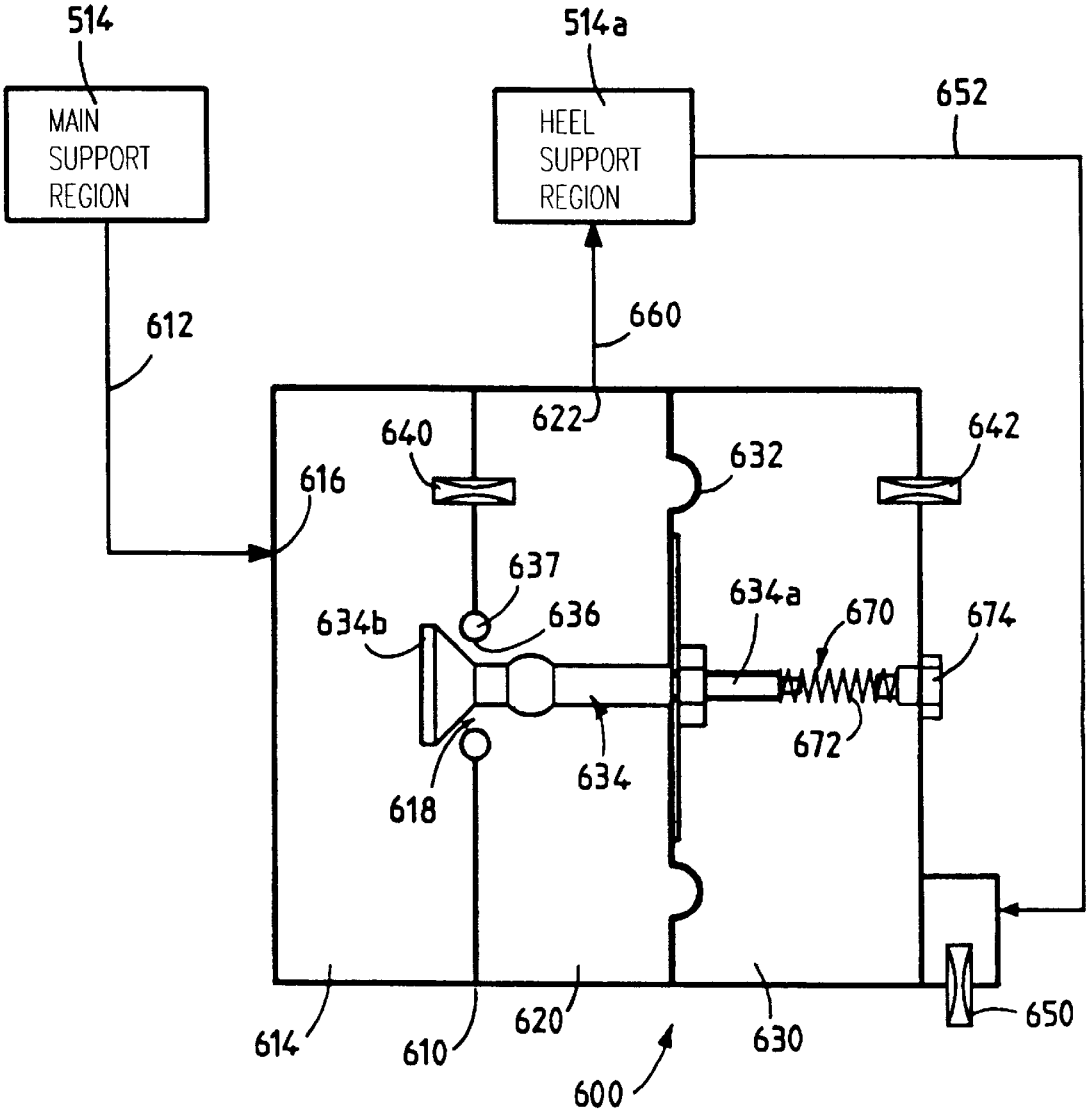
FIG. 3 is a detailed axial and longitudinal section view showing the operating principle of a currently preferred embodiment of a pressure-regulating valve of the invention connected between the main support region excluding the heel support region, and the heel support region.

With reference to FIG. 3 in the assignee's prior document, that document describes how the support element such as a mattress may be subdivided into a plurality of chambers, each of which is provided with the same measurement device 30 with its own regulating means, so that the structure becomes complex, costly, and complicated to operate.

Figure 2:
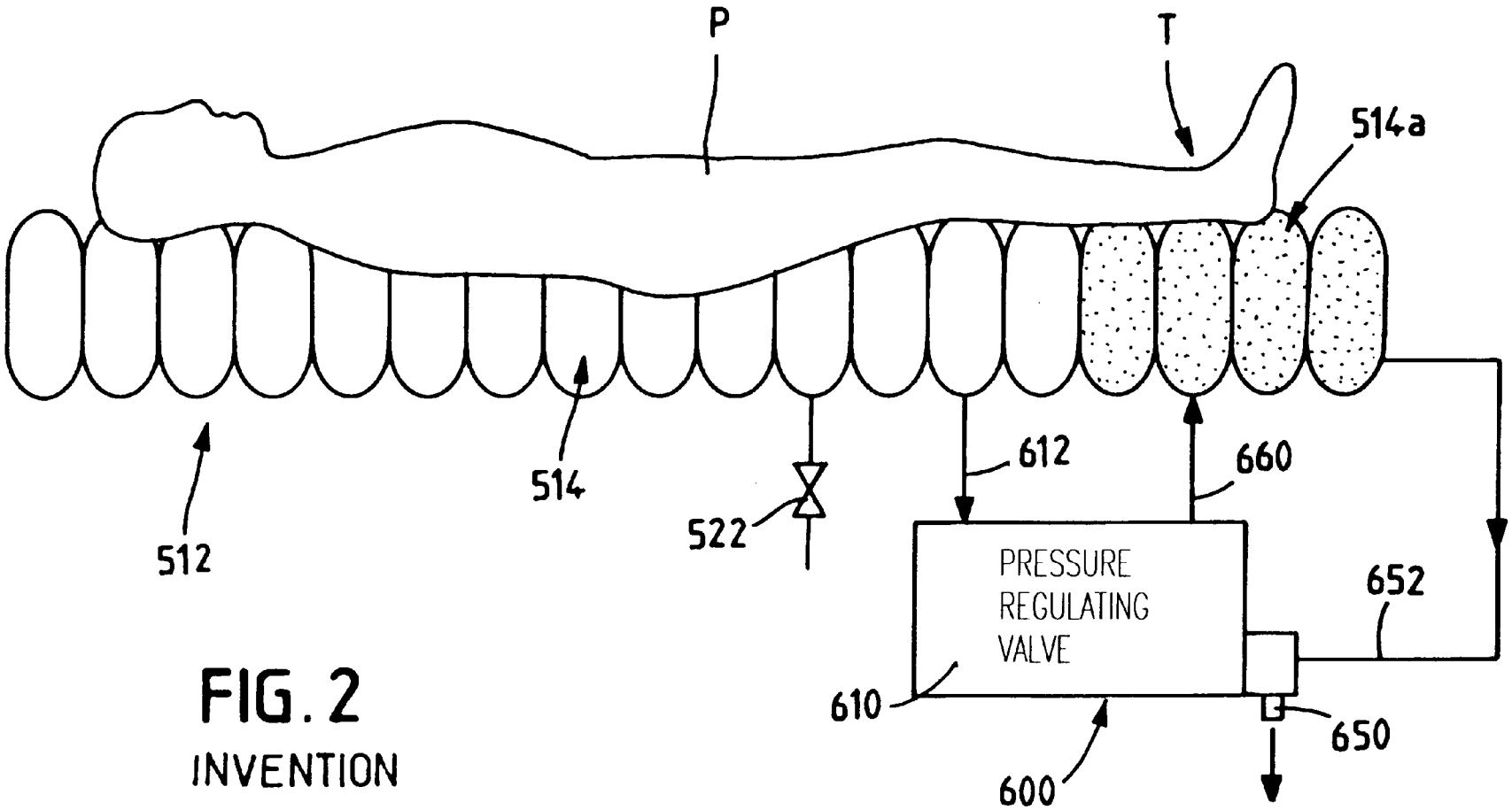
FIG. 2 is a diagrammatic view of the modified support portion of the invention showing how a specific support region for supporting the heel region is created that taps fluid from at least one support region other than the heel support region.
Figure 4:
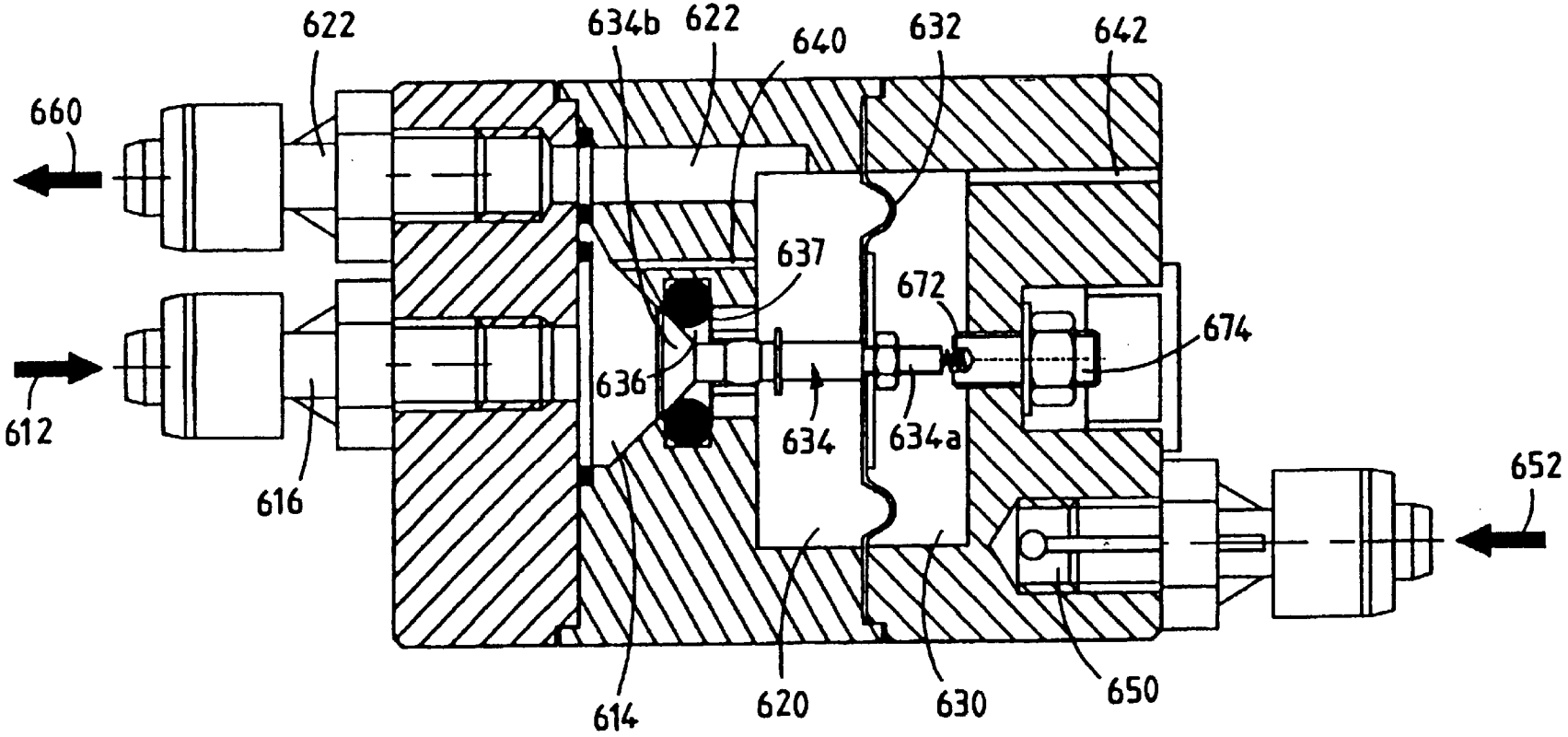
FIG. 4 is an axial and longitudinal section view of a practical embodiment of a pressure-regulating valve whose operating principle is shown in FIG. 3.

In the embodiment of the present invention shown in accompanying FIGS. 2 to 4, the apparatus is modified so that the support device, e.g. a mattress, is subdivided into at least two support regions, including a support region specifically for supporting the heel region. By way of simplification, and to facilitate understanding, elements identical to those of the assignee's prior document are reproduced with the same reference numbers, while modified elements are given the same references plus 500.

In the context of the present invention, the patient is referenced P, and the patient's heel region is referenced T. The support element is given overall reference 512, the first or main support region is referenced 514, and the second support region for supporting the heel region is referenced 514*a*. It is to be understood that each of the support regions 514, 514*a* may be made up of a plurality of inflatable tubes.

In the context of the present invention, the first support region or main region 514, which may naturally be subdivided into a plurality of regions, may be inflated under an adjustable predetermined initial inflation pressure as in the structure shown in accompanying FIG. 1, briefly summarized above, and described in full detail in the assignee's previous document.

In the context of the present invention, the second support region 514*a* for supporting the heel region is connected so that it taps fluid from the first support region via link means 600. The link means 600 are preferably constituted by a pressure-regulating valve 610 having its inlet fed via a feed pipe 612 communicating with the main support region 514, and its outlet communicating with the heel or second support region 514*a* via a pipe 660.

The structure of the currently preferred embodiment of the pressure-regulating valve 610 is described below with reference to FIG. 3.

FIG. 3 is a block diagram of the main support region 514 and of the heel region support region 514*a,* together with the inlet pipe 612 and the outlet pipe 660.

In the currently preferred embodiment, the regulating valve 610 includes an admission chamber 614 having an inlet 616 communicating with the inlet pipe 612 and an outlet 618 communicating with a pressure-regulating chamber 620 whose outlet 622 communicates with the outlet pipe 660 communicating with the second support region 514*a*. In the embodiment of the invention shown in FIG. 3, the valve 610 also includes an independent damping chamber 630 separated from the pressure-regulating chamber 620 by a moving partition 632 supporting a piston 634 for closing off an orifice 636 providing communication between the admission chamber 614 and the pressure-regulating chamber 620.

In an advantageous variant embodiment, the admission chamber 614 and the pressure-regulating chamber 620 further communicate with each other continuously via a calibrated orifice 640.

In another advantageous embodiment of the invention, the damping chamber 630 also communicates continuously with the outside via a calibrated orifice 642.

In yet another advantageous embodiment of the invention, the second support region 514*a* for supporting the heel region T communicates continuously with the outside via a calibrated orifice 650 which, to simplify matters, may be included in the regulating valve 610 as shown, and connected to the second support region 514*a* via a pipe 652.

In the context of the embodiment shown, it can be understood that the pressure value at which the piston 634 closes off the orifice 636 may be adjusted by providing adjustment means 670 for adjusting the pressure force acting against the rod 634*a* of the piston 634 so that the head 634*b* of the piston 634 closes off the orifice 636 at a given pressure value only. These adjustment means 670 may, for example, comprise a resilient element 672 exerting one-way pressure against the rod 634*a* of the piston 634, the unilateral pressure value of the resilient element being adjusted by a pressure adjustment member proper 674 such as a pressure calibration nut and screw system.

With reference to FIGS. 2 to 4, it can be understood that this system is particularly simple to operate.

The first support region 514, which in this example supports the main portion of the body of the patient P, with the exception of the heel region T, is inflated by using a procedure identical to that described with reference to FIG. 1 of the assignee's prior document. Once the first support region 514 has been inflated to a certain pressure value, it feeds firstly, via the pipe 612, the admission chamber 614 and then the pressure-regulating chamber 620, and finally, via the pipe 660, the second support region 514*a* for supporting the heel region T. Above a certain pressure value, a leak is produced via the pipe 652 and via the calibrated orifice 650 for leakage. Naturally, this calibrated orifice 650 is small enough for the second support region 514*a* to take a relatively long period of time to deflate. Since the orifice 636 is much larger, and is fed to a greater extent via the pipe 612 from the first support region 514, the second support region 514*a* is inflated until the pressure in the admission chamber 614 reaches a value that is greater than the calibration pressure exerted by the pressure adjustment means 670, whereupon the head 634*b* of the piston 634 bears against the orifice 636 which is sealed by means of a sealing gasket 637. As from this pressure value, the pressure-regulating chamber 620 is maintained at essentially constant pressure because of the existence of the fluid orifice 640 via which the admission chamber 614 communicates with the pressure-regulating chamber 620, and which substantially exactly compensates for the continuous leak obtained via the fluid orifice 650 at the outlet of the second support region 514*a* for supporting the heel region. The existence of the leakage orifice 642 via which the damping chamber 630 communicates with the outside facilitates proper operation of the moving partition 632, e.g. formed by a flexible membrane, e.g. made of a rubber or an equivalent material.

This structure makes it particularly simple to adjust the pressure in the second support region 514*a* for supporting the heel region T to a pressure value that is not more than the pressure value in the first support region 514, or to an adjustable fraction thereof.

In the context of the invention, it is also possible to provide the first support region 514 with a regulating valve 522 similar to the valve 22 (FIG. 1) and controlled by the control station 42 so that the first support region 514 operates in accordance with the method and apparatus described with reference to FIG. 1 in the assignee's prior document, which method and apparatus are not modified.

The present invention makes it possible to create a specific heel region whose pressure is made specific by very simple means, i.e. by tapping fluid from the first support region.

It is thus possible to obtain a lower pressure value in the heel region which constitutes a region of the body that is most sensitive to developing bedsores for a patient who is confined to bed for a prolonged period. Since the pressure in the heel support region is lower than that in the remainder of the support, the heels can penetrate more deeply into the support or mattress so that the legs rest over their entire lengths on the support or mattress, thereby relieving the pressure exerted on the heels.

In the context of the invention, it is possible to cause the pressure to vary as a function of the relative position of the patient on the support, of the patient's weight, and of the patient's morphology, or else as a function of the particular needs of the treatment.

A preferred application of the invention is thus to preventing or treating bedsores.

We claim:

1. A method of supporting the body of a patient, the method consisting in providing at least one support element, in particular a mattress, subdivided into at least two closed, flexible, controlled-release regions that are inflatable with fluid under a pressure that is a function of the set penetration distance to which the body of the patient penetrates into the support element, namely at least one first support region for supporting the body of the patient other than in its heel region, and a second support region specifically for supporting the heel region, wherein the second support region is inflated by tapping fluid from the first support region.

2. A method according to claim 1, wherein the pressure in the second support region is adjustable as a function of the pressure in the first support region.

3. A method according to claim 1, wherein the pressure in the second support region for supporting the heel region is substantially constant.

4. A method according to claim 1, wherein the pressure in the second support region for supporting the heel region is a constant fraction of the pressure in the first support region.

5. The method as recited in claim 1, wherein the fluid is one of a gas and liquid.

6. A device for supporting the body of a patient, the device including at least one support element, in particular a mattress, subdivided into at least two flexible controlled-release regions that are inflatable with fluid under a pressure that is a function of the set penetration distance to which the body of the patient penetrates into the support element, namely at least one first support region for supporting the body of the patient other than in its heel region, and a second support region specifically for supporting the heel region, wherein the second support region is connected by a link to the first support region so as to be inflated by tapping fluid from the first support region.

7. A device according to claim 6, wherein the link between the first support region and the second support region for supporting the heel region includes a pressure-regulating valve.

8. A device according to claim 7, wherein the pressure-regulating valve is adjusted to give a pressure value that is substantially constant in the second support region.

9. A method for preventing or medically treating bedsores using the device as recited in claim 8.

10. A device according to claim 6, wherein the pressure-regulating valve is adjusted to give a pressure value in the second support region for the heel that constitutes an essentially constant fraction of the pressure in the first support region.

11. A method for preventing or medically treating bedsores using the device as recited in claim 10.

12. A method for preventing or medically treating bedsores using the device as recited in claim 7.

13. A device according to claim 6, wherein the regulating valve comprises an admission chamber having an inlet communicating with the first support region and an outlet communicating at least temporarily with a pressure-regulating chamber whose outlet communicates with the second support region for supporting the heel region, and an independent damping chamber separated from the pressure-regulating chamber by a moving partition supporting a piston for closing off an orifice via which the admission chamber communicates with the pressure-regulating chamber.

14. A device according to claim 13, wherein the admission chamber and the pressure-regulating chamber also communicate with each other continuously via a calibrated orifice.

15. A method for preventing or medically treating bedsores using the device as recited in claim 14.

16. A device according to claim 13, wherein the damping chamber communicates continuously with the outside via a calibrated orifice.

17. A method for preventing or medically treating bedsores using the device as recited in claim 10.

18. A method for preventing or medically treating bedsores using the device as recited in claim 13.

19. A device according to claim 6, wherein the second support region for supporting the heel region communicates continuously with the outside via a calibrated orifice.

20. A method for preventing or medically treating bedsores using the device as recited in claim 19.

21. A method for preventing or medically treating bedsores using the device as recited in claim 6.

22. The device as recited in claim 6, wherein the fluid is one of a gas and a liquid.

23. A device for supporting a body, the device comprising:

a first support element including a first flexible controlled-release region that is inflatable with a fluid under a first pressure;

a second support element including a second flexible controlled-release region that is inflatable with the fluid under a second pressure; and a fluid coupling device to couple the first region to the second region, wherein the second region is inflated by tapping the fluid from the first region.

24. The device as recited in claim 23, wherein the fluid is one of a gas and a liquid.

25. A method of treating bedsores using the device as recited in claim 23, wherein the first element supports a first region of the body and the second support element supports a second region of the body.

26. The method as recited in claim 25, wherein the first pressure is a function of a set penetration distance to which the first portion of the body penetrates into the first support element.

27. The method as recited in claim 26, wherein the second pressure is substantially constant.

28. The method as recited in claim 26, wherein the second pressure is an essentially constant fraction of the first pressure.

29. The device as recited in claim 23, wherein:

the first support element is to support a first region of the body; and the second support element is to support a second region of the body.

30. The device as recited in claim 29, wherein:

the first pressure is a function of a set penetration distance to which the first portion of the body penetrates into the first support element.

31. The device as recited in claim 30, wherein the fluid coupling device comprises a pressure-regulating valve.

32. The device as recited in claim 31, wherein the pressure-regulating valve controls the second pressure so as to be substantially constant.

33. The device as recited in claim 31, wherein the pressure-regulating valve controls the second pressure so as to be an essentially constant fraction of the first pressure.

34. The device as recited in claim 31, wherein the pressure-regulating valve comprises an admission chamber having an inlet communicating with the first region and an outlet communicating at least temporarily with a pressure-regulating chamber whose outlet communicates with the second region, and an independent damping chamber separated from the pressure-regulating chamber by a moving partition supporting a piston for closing off an orifice via which the admission chamber communicates with the pressure-regulating chamber.

35. A method of supporting a body, the method comprising:

providing a first support element including a first flexible controlled-release region that is inflatable with a fluid under a first pressure;

providing a second support element including a second flexible controlled-release region that is inflated with the fluid under a second pressure;

coupling the first region to the second region; and inflating the second region by tapping the fluid from the first region.

36. The method as recited in claim 35, further comprising:

inflating the first support element with one of a gas and a liquid.

37. The method as recited in claim 35, further comprising:

supporting a first region of the body with the first support element; and supporting a second region of the body with the second support element.

38. The method as recited in claim 37, further comprising:

controlling the first pressure as a function of a set penetration distance to which the first portion of the body penetrates into the first support element.

39. The method as recited in claim 38, further comprising:

controlling the second pressure so as to be substantially constant.

40. The method as recited in claim 38, further comprising:

controlling the second pressure so as to be an essentially constant fraction of the first pressure.

* * * * *